US005584097A

United States Patent [19]

Lu

[11] Patent Number: 5,584,097

[45] Date of Patent: Dec. 17, 1996

[54] FULL HANDLE FOR A TRUCK

[76] Inventor: Kuo-Yu Lu, No. 8, Lane 308, Sha Tien Rd., Ta-Tu Hsiang, Taichung Hsien, Taiwan

[21] Appl. No.: 371,969

[22] Filed: Jan. 12, 1995

[51] Int. Cl.[6] ..... B25G 1/04

[52] U.S. Cl. ..... 16/115; 190/14; 190/104; 280/655

[58] Field of Search ..... 16/115, 111 R, 16/DIG. 38; 280/47.315, 47.371, 655, 655.1; 190/14, 15 R, 104, 18 R, 18 A

[56] References Cited

U.S. PATENT DOCUMENTS 5,400,472 3/1995 Chang ..... 16/115
5,459,908 10/1995 Chen ..... 16/115

FOREIGN PATENT DOCUMENTS 1098331 1/1968 United Kingdom ..... 16/115

*Primary Examiner*—Chuck Y. Mah
*Attorney, Agent, or Firm*—Bacon & Thomas

[57] ABSTRACT

A handle or pull link for a trunk includes: a main pull link, an extension tube, an outer tube, a controller and a ratchet rack. Each end of the main pull link includes a square groove. The extension tube constitutes a square hollow post and has a link therein. The outer tube also constitutes a square hollow post. The controller includes a fixing seat, an engagement tooth and a control plate. Square grooves of both the extension tube and the main link engage each other with an adjusting rod penetrating through the extension tube parallel to the pull link by means of vertical square holes on each side so as to be movable up and down. The controller is fitted to the end of the extension tube with the link bar in the extension tube being connected to the adjusting rod and controller, while the extension tube is slidably fitted to the outer tube. The ratchet rack of the outer tube cooperates with the controller to cause engagement and disengagement between the engagement tooth of the controller and the ratchet rack to enable variable positioning of the extension tube within the outer tube.

5 Claims, 3 Drawing Sheets

FULL HANDLE FOR A TRUCK

BACKGROUND OF THE INVENTION

The present invention relates to an improvement of a pull link or handle for a trunk that includes variable extension links incorporating a matched controller and ratchet rack assembly such that, when not in use, it can be stored to save space, and when in use, it can be adjustably extended to match the height of the user.

Most large trunks in general are difficult to carry due to their bulk dimensions and heavy weight so they have mounted a pull link or handle for easily moving the trunk; however, the conventional trunk pull link is a long bar that has a fixed length and it always keeps a fixed length over the trunk. Because such a pull link is not capable of being stored when not in use, it often gets broken during use or handling.

Some improvements have been proposed, such as a two-sectional extension link design, however because its pull link has two sections only, when storing or pulling out the pull link, the pull link is considered either too long or too short due to the difference of the body height of various user's and therefore it is not convenient for use.

These and other objects and advantages of the present invention will become apparent to those skilled in the art after considering the following detailed specification together with the accompanying drawings.

DETAILED DESCRIPTION OF THE PREFERRED EMBODIMENT

Figure 1:
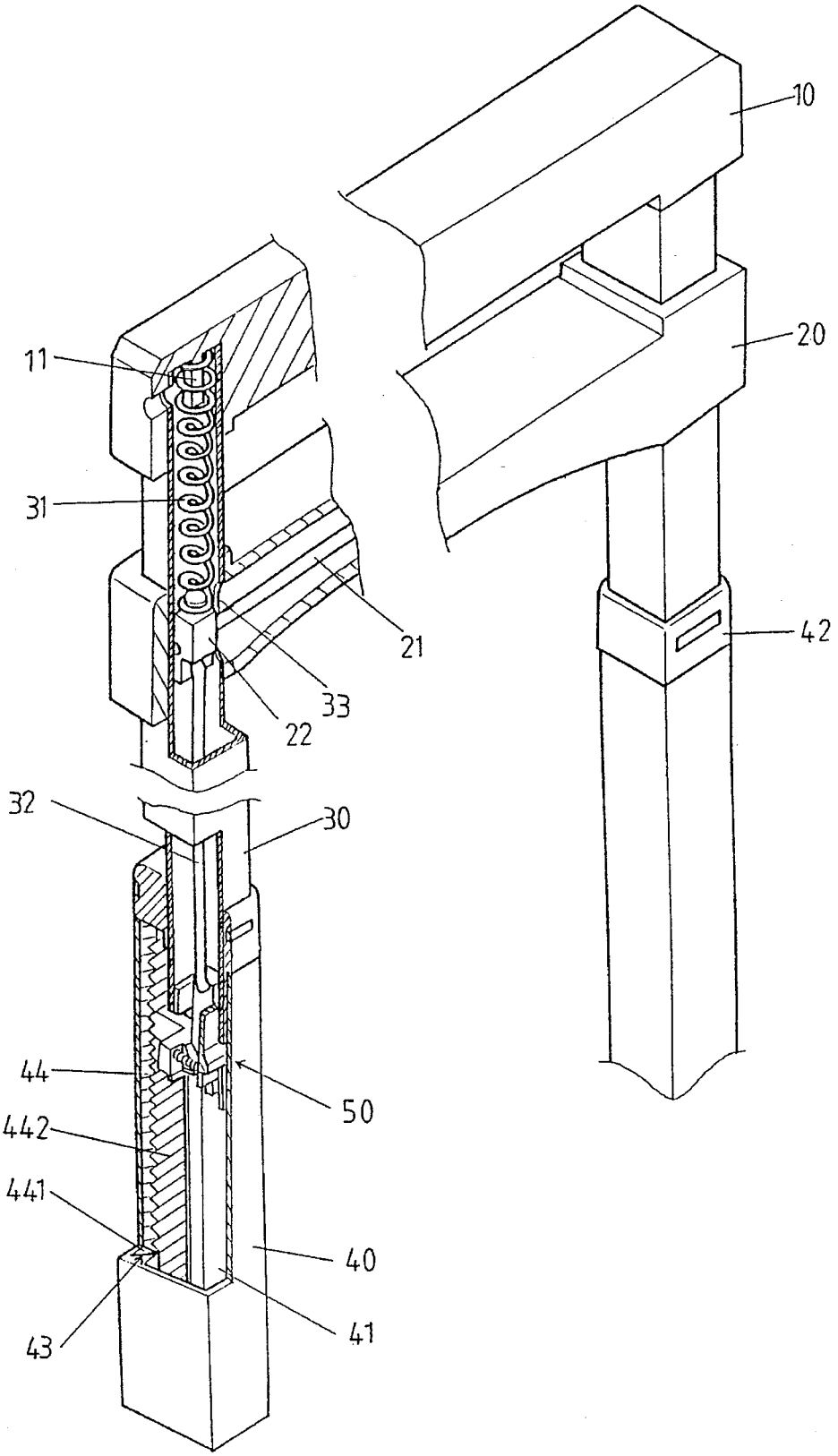
FIG. 1 is an elevational-sectional view of the structure of the present pull link.

Referring to FIG. 1, the present invention comprises a main pull link or handle 10, an adjusting bar 20, an extension tube 30, an outer tube 40 and a controller 50 wherein, the main pull link 10 has a square groove formed in each end, and the bottom of the groove has a read head 11;

on each end, the adjusting rod 20 has a hollow post with a vertical square hole and a linking bar 21 penetrating through;

the extension tube 30 is a square hollow post, with an inner top housing a spring 31, and the spring 31 extends about the reed head 25 of link block 22, and a link 32 is hung on an suspension hole 24 formed under the link block 22;

on one side of the outer tube 40 is a square hollow post with a long slideway 41, and on the other side has a dovetail groove 43, and on top is provided a neck sleeve 42;

the controller 50 has a fixing seat 51 which accommodates a control plate 52, an engagement tooth 54 and an engagement spring 56. The control plate 52 is engaged with the engagement tooth 54 by means of its bevel 53 thereunder, and the engagement tooth 54 is fitted to the engagement spring 56 by means of its reed head 55 for holding up the internal sides of fixing seat 51, enabling the tooth part of engagement tooth 54 to project over the fixing seat 51.

Figure 2B:
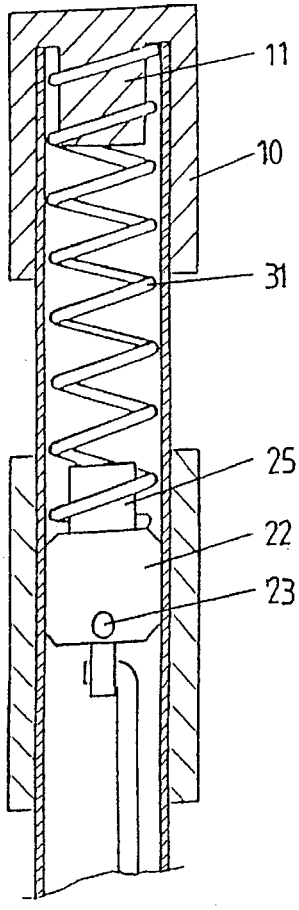
FIG. 2B is a second sectional view of the structure of the present pull link.
Figure 2B:
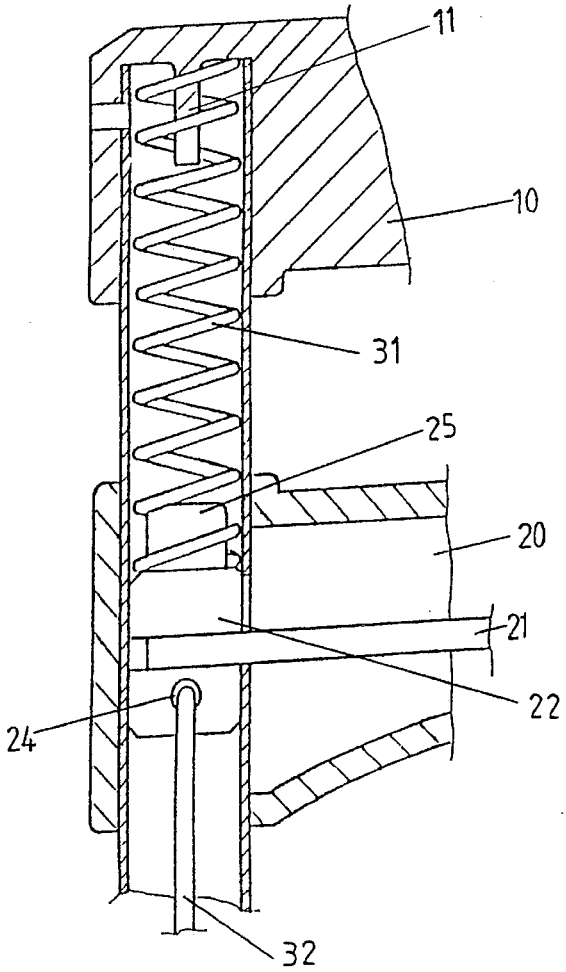
Figure 2A:
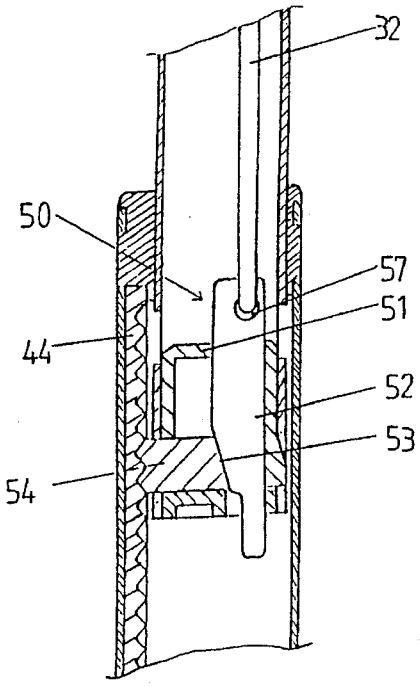
FIG. 2A is a first sectional view of the structure of the present pull link.

The structure of the assembly is as follows:

Referring to FIGS. 1, 2A and 2B, extension tube 30 is set in the groove of main pull link 10 to enable the spring 31 in extension tube 30 to fit together with the reed head 11 in the groove of main pull link 10, the other end of spring 31 is fitted together with the reed head 25;

with a vertical square hole on each end the adjusting rod 20 penetrates through extension tube 30 and is parallel to the main pull link 10, the linking bar 21 of adjusting rod 20 also penetrates through a slide hole or slot 33 formed in extension tube 30 and sets in the link hole 23 of link block 22;

the controller 50 is secured to the end of extension tube 30, and the control plate 52 is hung with the link 32 which extends through suspension hole 57;

the extension tube 30 is set in the outer tube 40, enabling the engagement tooth 54 on the controller 50 to engage with ratchet rack 44, which has dovetail seat 441 received in groove 43, of outer tube 40.

Figure 3B:
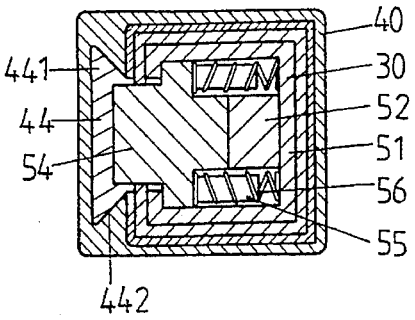
FIG. 3B is a cross-sectional view taken along line 3B—3B of FIG. 3A.
Figure 3D:
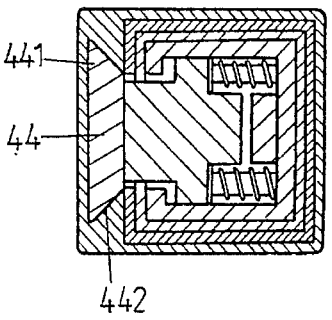
FIG. 3D is a cross-sectional view taken along line 3D—3D of FIG. 3C.
Figure 3A:
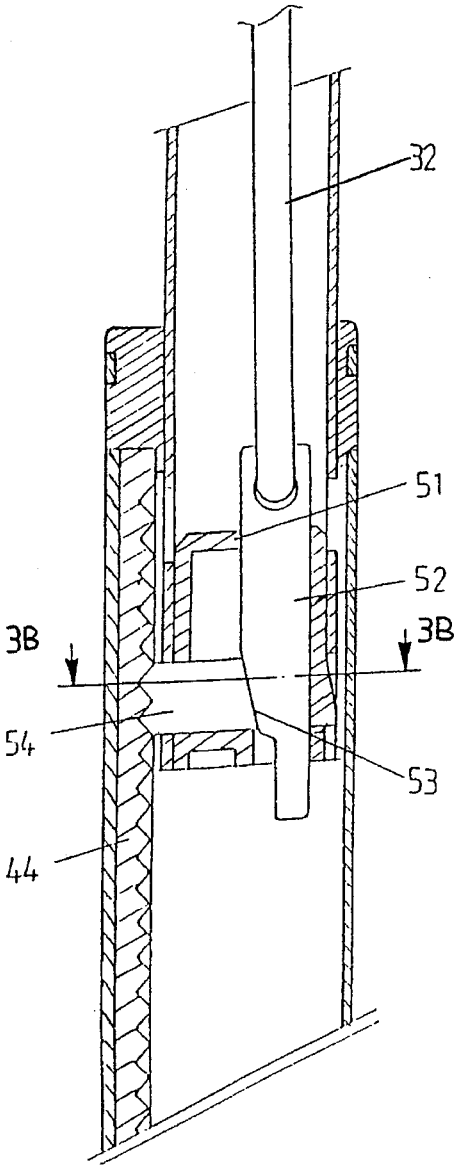
FIG. 3A is a sectional view showing an engagement state of the present pull link.
Figure 3C:
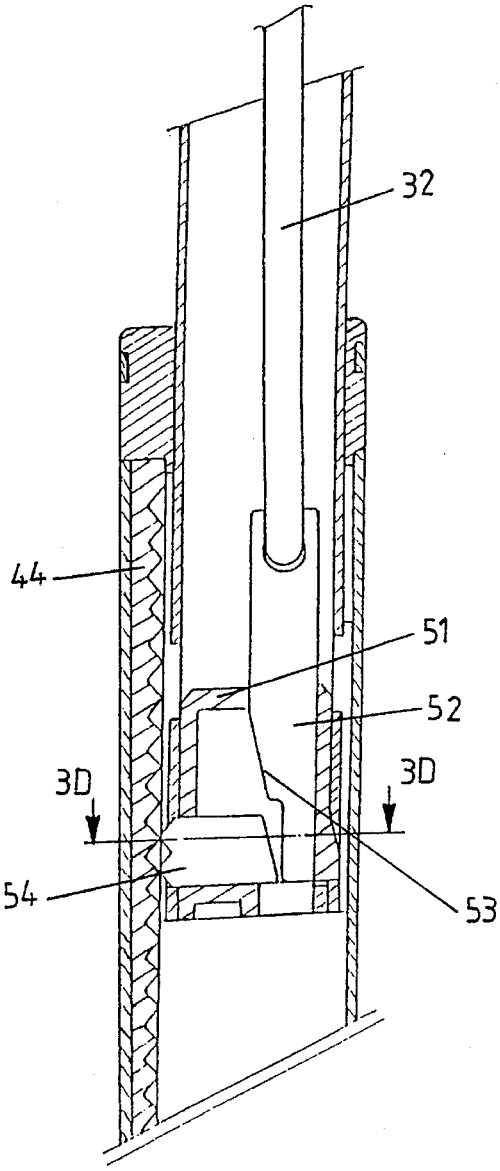
FIG. 3C is a sectional view showing a disengagement state of the present pull link.

Referring to FIGS. 3A–3D, to adjust the length of extensible tube 30, the user may hold on the main pull link 10 and adjusting rod 20 with his hand, pulling up the adjusting rod 20 with one or more fingers causes linking bar 21 to move up to the top end of slide hole 33 on extension tube 30 and thereby causes the link block 22 to move and to compress the spring 31, and moving up of link block 22 will cause the link 32 to also move and further causes the control plate 52 on the controller 50 to move up too, at which time the bevel 53 of control plate 52 will disengage with the engagement tooth 54 so that the engagement tooth 54 may move up and down along the slideway 41 of outer tube 40. Referring to FIG. 3B, extension tube 30 can be adjusted to alter the length of the assembly as required by the user, and the neck sleeve 42 on the outer tube 40 can prevent the extension tube 30 from pulling out the outer tube 40.

When the pull link for the trunk has reached the length necessary for the user, the user only needs to release adjusting rod 20 to fix extension tube 30 in place. The spring 31 on the top end of extension tube 30 will push down the link block 22 and force it back to the original position. Due to the presence of linking bar 21, adjusting rod 20 will be pushed back to the original position, in other words, linking bar 21 will return to the bottom end of the slide hole 33, and the linking bar 21 connected to the link block 22 will be pushed down for bringing the control plate 52 on the controller 50 back to the original position along the fixing seat 51. The bevel 53 aids in returning control plate 52 back to the original position and into engagement with the engagement tooth 54. Because there is no space for the engagement tooth 54 to move backward, the tooth part of engagement tooth 54 will totally be engaged with the ratchet 442 on the ratchet rack 44 so that extension tube 30 can be fixed at the length necessary for the user (FIGS. 3A and 3B) so as to meet the requirement of moving the baggage.

To conclude the aforesaid statement, the advantages of the present invention can be listed below:

1. As the present pull link or handle is extensible, the extension tube 30 can be pulled out for use while the extension tube 30 can be stored in the outer tube 40 when not in use.

2. With the matching of controller 50 to the ratchet 442 on the ratchet rack 44, the user may adjust the length of extension tube 30 at random as required.
3. The present adjusting rod 20 is parallel and close to the main pull link 10 so the user may hold them with one hand without the need of changing one's body position, in other words, the user may change and fix the length of extensible tube 30 anytime when necessary so that it is easy to use.

What is claimed is:

1. A handle for a trunk comprising:

a main pull link having opposing ends each provided with a square groove;

an adjusting bar having opposed ends each of which includes a vertically extending, square hole;

a pair of laterally spaced outer tubes each constituting a hollow, square post having a plurality of inner sides with one of said inner sides defining a slideway;

a pair of hollow, square extension tubes each having first and second open ends, each of said extension tubes extending through the square hole in a respective end of said adjusting bar with the first open end of each of said extension tubes being received in a respective said square groove and the second open end of each of said extension tubes being slidably received in a respective said outer tube, each of said extension tubes including a section between said first and second open ends that includes a longitudinally extending slot;

a pair of ratchet racks each secured within a respective said outer tube;

a linking bar extending through said adjusting bar, said linking bar including opposing ends each of which extends through the slot formed in a respective said extension tube;

first and second control assemblies each including a fixing seat fitted to the second open end of a respective said extension tube, an engagement tooth member laterally slidably supported by said fixing seat for movement between a fixing position in which said engagement tooth member is interlocked with a respective said ratchet rack and a release position wherein said engagement tooth member may slide along said slideway, and a control plate vertically slidably received within said fixing seat, said control plate being adapted to engage and shift said engagement tooth member to said fixing position when in a first position and permitting said engagement tooth member to assume said release position when in a second position;

link means interconnecting said linking bar and the control plate of a respective one of said first and second controller assemblies within each of said extension tubes; and means for biasing each of said control plates towards said first position, wherein manually lifting of said adjusting bar relative to said main pull link causes each of said control plates to shift to said second position through said link means, thereby placing each of said engagement tooth members in said release position and permitting said extension tubes to shift relative to said outer tubes to selectively control the extension of said handle and wherein release of said adjusting bar forces said control plates to assume said first position due to the presence of said biasing means thereby placing said engagement tooth members in said fixing position.

2. The handle according to claim 1, wherein each of said ratchet racks includes a dovetail seat which is slidably received within a dovetail groove formed in a respective said outer tube.

3. The handle according to claim 1, wherein each said link means includes a link block and a link extending between the link block and a respective said control plate.

4. The handle according to claim 3, wherein said biasing means comprises a pair of springs each extending within a respective said extension tube between a respective said link block and said main pull link.

5. The handle according to claim 4, wherein said main pull link is formed with a reed head within each said groove about which a respective said spring extends.

* * * * *